US006644230B1

(12) United States Patent
Webster

(10) Patent No.: US 6,644,230 B1
(45) Date of Patent: Nov. 11, 2003

(54) LOCKING MARINE BITT

(75) Inventor: Elwood Ranck Webster, Camarillo, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/261,073

(22) Filed: Oct. 1, 2002

(51) Int. Cl.[7] ..... B63B 21/04
(52) U.S. Cl. ..... 114/218; 410/101
(58) Field of Search ..... 114/218; 410/101

(56) References Cited

U.S. PATENT DOCUMENTS 4,354,445 A * 10/1982 Kafka et al. ..... 114/218
5,106,248 A * 4/1992 Harris ..... 410/107
6,234,101 B1 * 5/2001 Czipri ..... 114/218

* cited by examiner

*Primary Examiner*—Jesus D. Sotelo
(74) *Attorney, Agent, or Firm*—David Kalmbaugh

(57) ABSTRACT

A marine bitt which is easily removed from the deck of an ocean going vessel and attached to the deck of the vessel. The marine bitt is used to secure cargo including vehicles to the deck of a barge or other ocean going vehicles. The easy removal of the marine bitt allows for rapid loading and unloading of cargo from the deck of the vessel.

14 Claims, 2 Drawing Sheets

LOCKING MARINE BITT

BACKGROUND OF THE INVENTION

1. Field of the Invention

The present invention relates generally to marine mooring devices for use on a boat, ship or the like. More specifically, the present invention relates to a marine bitt which is easily removed from the deck of an ocean going vessel and attached to the deck of the vessel.

2. Description of the Prior Art

In the past ocean going vessels such as military and commercial barges, transport ships and the like have used heavy duty marine bitts to receive mooring lines to secure the vessel to a pier, dock or other facility and to tie vehicles, cargo and the like to the vessel. Currently, military and civilian personnel on board ships are required to attach heavy-duty bitts when and where the bitts are required by bolting the marine bitts to the deck of the ship. Quick removal of the marine bitts from the deck of a barge or the like is required to allow off loading of cargo from the barge. It may take up to thirty minutes to remove each bitt from the deck of the vessel.

The operation is also inherently dangerous to personnel who work at the edge of the vessel on the deck when there are rough seas or when the weather is bad. Often, injuries occur which may seriously cripple further operations on board the ship. The process is also time-consuming resulting in a reduction of cargo to the beach, thus degrading the mission capability of the vessel.

Accordingly, there is a need to design a marine bitt which allows for quick removal of the bitt from the deck of marine vessel. In addition, there is a need to provide a marine bitt which is sufficient strength to resist forces exerted on the marine bitt by a tow rope attached the bitt.

SUMMARY OF THE INVENTION

The present invention was designed to overcome the disadvantages of the past, including those mentioned above, in that it comprises a relatively simple, yet highly effective quick change marine bitt for use on a barge or the like.

The marine bitt comprising the present invention has a base portion and an upstanding post. The marine bitt also has a locking stem angled at approximately 45 degrees. The locking stem fits within a marine bitt support structure also angled at approximately 45 degrees and is removable therefrom. A locking pin is inserted into the locking stem for the marine bitt securing the marine bitt to the deck of the vessel.

DETAILED DESCRIPTION OF A PREFERRED EMBODIMENT

Figure 1:
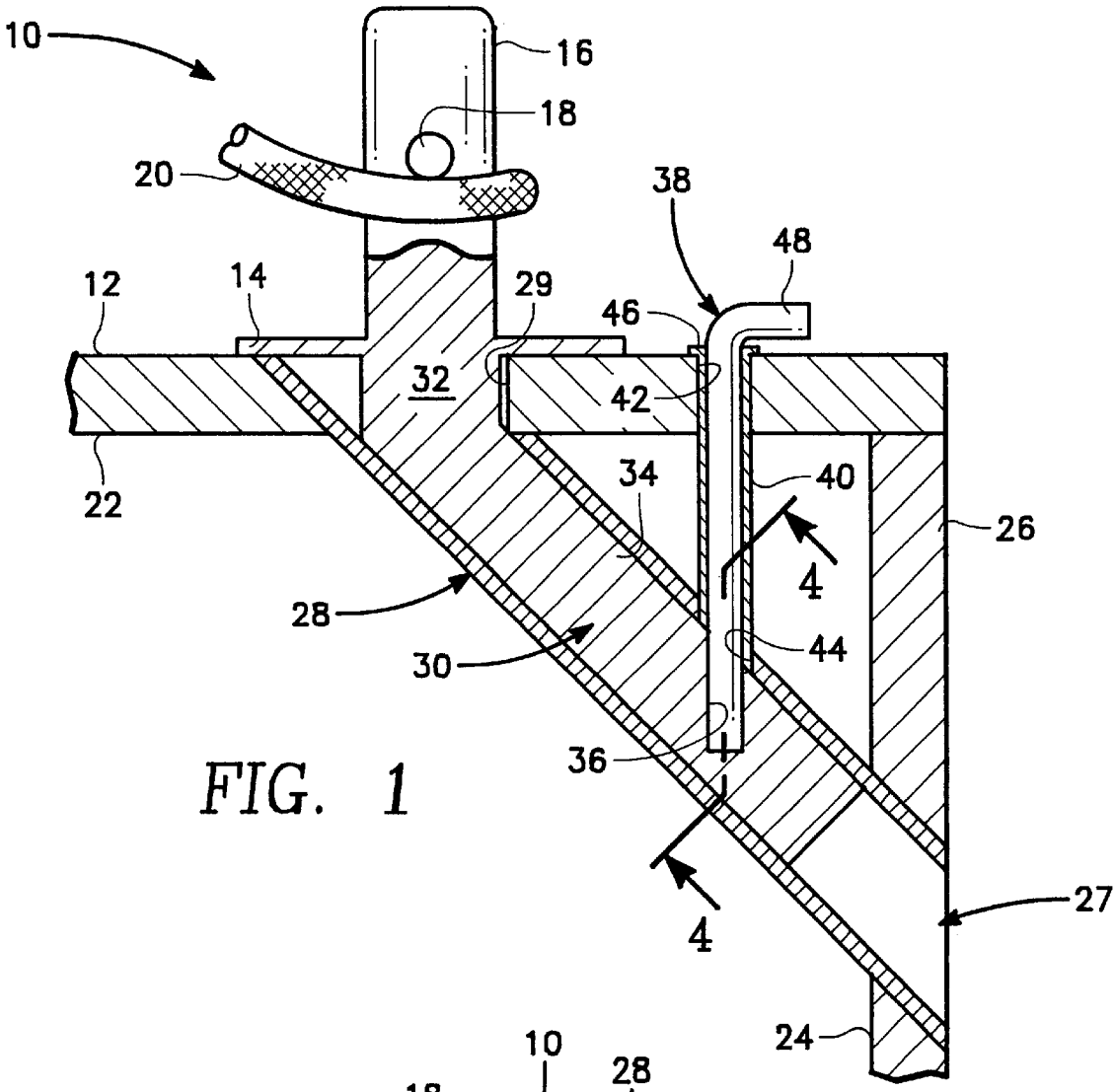
FIG. 1 is a side view, in partial section, of the locking marine bitt for use on a barge or the like which constitutes the present invention.

Referring to FIGS. 1–4 there is a marine bitt, designated generally by the reference numeral 10 which can be fastened to a surface or deck 12 of a barge. Marine bitt 10 is designed for a quick change, that is the bitt 10 can be removed and fastened to the deck within a matter of 10–30 seconds and requires two personnel standing at approximately 3–4 feet from the edge of deck 12. By contrast existing technology which requires the bitts to bolted to the deck and unbolted from the deck takes at least 5–20 minutes depending on the sea state.

Figure 2:
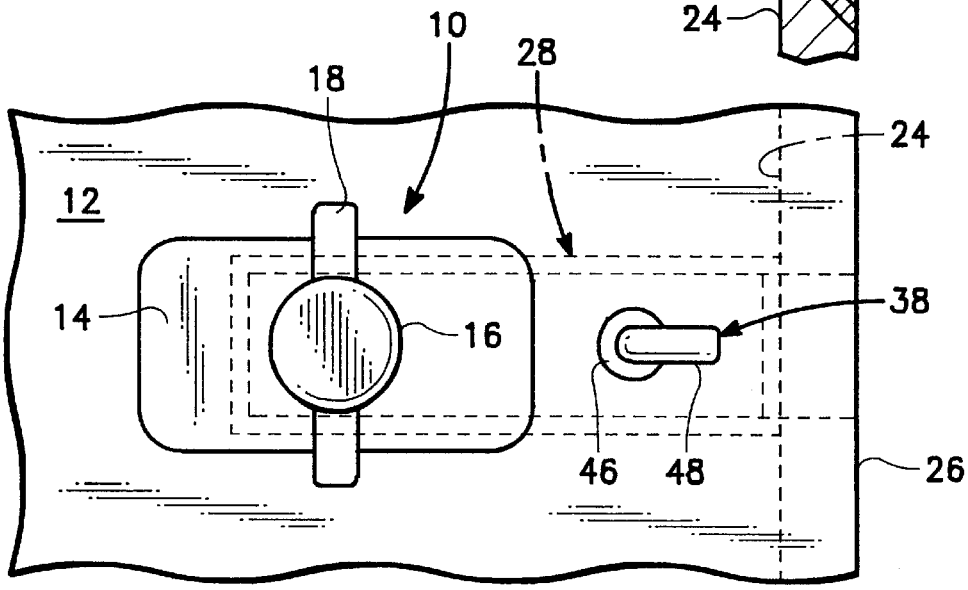
FIG. 2 is a top view of the locking marine bitt of FIG. 1.
Figures 3, 4:
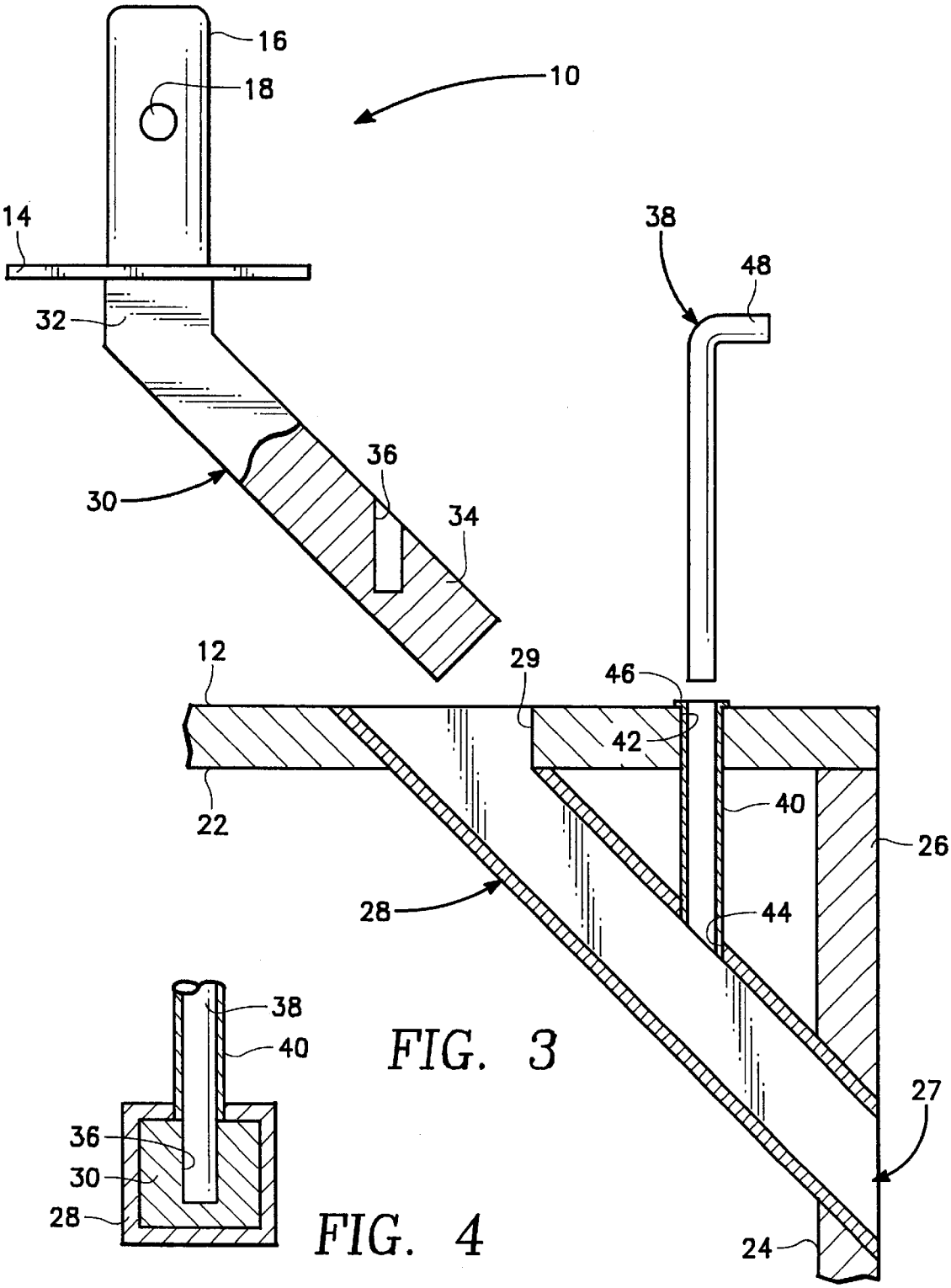
FIG. 3 is a view, in partial section, of the marine bitt of FIG. 1, when separated from the deck of the vessel.
FIG. 4 is a view along line 4—4 of the locking pin for the marine bitt of FIG. 1.

The marine bitt 10 has a base 14 and an upstanding post 16 generally circular in cross section. The base 14 of marine bitt 10 has a generally rectangular shape as is best shown in FIG. 2. Extending perpendicularly from the post 16 is a rod 18. Rod 18 secures a tow or tie down rope 20 in a fixed position on the post 16. The rod 18 prevents the rope 20 from sliding upward on the post 16 and then releasing itself from the post 16.

At this time, it should be noted that the base 14 may have multiple post or other fixtures extending upward from the base 14. The fixture may also be a chock, cleat or any other device which can secure a tow rope, mooring, chain, tie down rope to the deck of the vessel.

Mounted between the bottom surface 22 of the deck 12 and the inner surface 24 of the vessels hull 26 is a marine bitt support structure 28. Marine bitt support structure 28 is angled at approximately 45 degrees from an opening 29 on deck 12 of the vessel and also from hull 26 of the vessel. The marine bitt support structure 28 has a rectangular shape approximating a square and an interior. The marine bitt 10 and support structure 28 may be fabricated from stainless steel, cast steel, aluminum or other material which is resistant to the corrosive effects of seawater. The marine bitt support structure 28 is affixed to the bottom surface 22 of the deck 12 and the inner surface 24 of the vessels hull 26 by welds (not illustrated).

Each marine bitt 10 used on board the vessel includes a marine bitt locking stem 30. The locking stem 30 for each marine bitt 10 has an upper portion 32 extending vertically downward from base 14. Locking stem 30 also has a lower portion 34 which is angled at approximately 45 degrees such that locking stem 30 will slide into and fit within the interior of support structure 28, which is the vessel's receiving element for marine bitt 10. The upper portion 32 of the locking stem 30 is designed to fit within an opening 29 in deck 12, when marine bitt 10 is in the locked position as shown in FIG. 1. As shown in FIG. 1, the marine bitt 10 is configured as a unitary or one piece structure.

Located within the lower portion 34 of locking stem 30 is slot 36. Slot 36 receives the lower portion of a locking pin 38 when locking stem 30 for marine bitt 10 is fully inserted into support structure 28 in the manner shown in FIG. 1.

The upper end of a locking pin receiving cylinder 40 is positioned within an opening 42 in the deck 12 of the vessel. The lower end of receiving cylinder 40 fits within an opening 44 in support structure 28. The upper end of locking pin receiving cylinder 40 includes a flange 46 which rest on deck 12.

When the marine bitt 10 is in the locked positioned, as shown in FIG. 1, a user can insert the locking pin 38 through locking pin receiving cylinder 40 into 36 securing the marine bitt 10 to deck 12 of the vessel. The upper end of locking pin 38 includes a bent upper portion 48 which rest on flange 46 providing a gap between the bent upper portion 48 and the deck 12 of the vessel. The bend of bent upper portion 48 of locking pin 48 is approximately ninety degrees. This allows a user to pick up and remove the locking pin 38 from the locking stem 30 of marine bitt 10 which releases marine bitt 10 from structure 28. The user can then remove the marine bitt 10 from structure 28.

At this time it should be noted that locking pin 38 could have means for removal of the pin 38 from the locking stem 30. For example, a handle positioned at the upper end of locking pin could be used to remove the pin 38 from the locking stem 30.

As depicted in FIG. 1, there is opening 27 in the hull 26 of the vessel which is in alignment with marine bitt support structure 28. Opening 27 allows rain water and seawater from deck 12 to quickly drain through the interior of support structure 28 to the water line into the ocean.

At this time it should be noted that marine bitt 10 which when inserted into the support structure 28 provides a wedge which resist mooring and towing forces external to the vessel. Inboard or internal forces to the vessel are resisted by a rotational moment causing the marine bitt to bear against base portion 14 marine bitt support structure, and a shear force to be applied to locking pin 38.

From the foregoing it may readily be seen that the present invention comprises a new, unique and exceedingly useful marine bitt which is easily removed from the deck of an ocean going vessel and attach to the deck of the vessel. The marine bitt constituting the present invention constitutes a considerable improvement over the known prior art. Obviously, many modifications of the present invention are possible in light of the above teachings. It is therefore to be understood that within the scope of the appended claims that the invention may be practiced otherwise than as specifically described.

What is claimed is:

1. A marine bitt secured to the deck of a vessel and removable from the deck of said vessel, comprising:

a base resting on the deck of said vessel;

a circular post extending upward from said base, said circular post having a rod which is positioned on an upper portion of said circular post perpendicular to said circular post;

a generally rectangular shaped locking stem extending downward from said base, said locking stem having an upper portion which is perpendicular to said base and a lower portion which forms an angle of approximately forty five degrees with respect to the upper portion of said locking stem;

a generally rectangular shaped marine bitt support structure having one end secured to the deck of said vessel at a first angle of approximately forty five degrees from a rectangular opening within the deck of said vessel and the other end secured to the hull of said vessel at a second angle of approximately forty five degrees from the hull of said vessel, said marine bitt support structure receiving the lower portion of said locking stem and the opening in said deck receiving the upper portion of said locking stem when said marine bitt is secured to deck; and a locking pin having an angled upper portion, said locking having a lower portion which fits within a slot located in the lower portion of said locking stem, said locking pin when inserted into the slot in the lower portion of said locking stem locking said marine bitt to the deck of said ship.

2. The marine bitt of claim 1 wherein said base, said circular post and said locking stem form a unitary structure fabricated from a corrosion resistant material.

3. The marine bitt of claim 2 wherein said corrosion material is selected from the group consisting of stainless steel, cast steel and aluminum.

4. The marine bitt of claim 1 further comprising a locking pin receiving cylinder having one end secured to the deck of said vessel and the other end aligned with the slot in the lower portion of said locking stem.

5. The marine bitt of claim 1 wherein the other end of said marine bitt support structure is aligned with an opening in the hull of said vessel to allow rain and seawater from the deck of said vessel to drain through said marine bitt support structure and the opening in the hull of said vessel into the ocean.

6. The marine bitt of claim 1 wherein said marine bitt when inserted into said marine bitt support structure and secured thereto provides a wedge which resist mooring and towing forces external to said vessel.

7. The marine bitt of claim 1 wherein said marine bitt when inserted into said marine bitt support structure and secured thereto by said locking pin resist internal forces to said vessel by providing a rotational moment which causes the marine bitt to bear against said base and a shear force to be applied to said locking pin.

8. The marine bitt of claim 1 wherein said the rod of said circular post prevents a rope secured to said circular post from sliding upward on said post and being released from said post.

9. A marine bitt secured to the deck of a vessel and removable from the deck of said vessel, comprising:

a base resting on the deck of said vessel;

a circular post extending upward from said base, said circular post having a rod which is positioned on an upper portion of said circular post perpendicular to said circular post;

a generally rectangular shaped locking stem extending downward from said base, said locking stem having an upper portion which is perpendicular to said base and a lower portion which forms an angle of approximately forty five degrees with respect to the upper portion of said locking stem;

a generally rectangular shaped marine bitt support structure having one end secured to the deck of said vessel at a first angle of approximately forty five degrees from a rectangular opening within the deck of said vessel and the other end secured to the hull of said vessel at a second angle of approximately forty five degrees from the hull of said vessel, said marine bitt support structure receiving the lower portion of said locking stem and the opening in said deck receiving the upper portion of said locking stem when said marine bitt is secured to deck; and a locking pin having an angled upper portion, said locking having a lower portion which fits within a slot located in the lower portion of said locking stem;

a locking pin receiving cylinder having one end secured to the deck of said vessel and the other end aligned with the slot in the lower portion of said locking stem;

said locking pin when inserted into said locking pin receiving cylinder and the slot in the lower portion of said locking stem locking said marine bitt to the deck of said ship; and said base, said circular post and said locking stem forming a unitary structure fabricated from a corrosion resistant material.

10. The marine bitt of claim 9 wherein said corrosion material is selected from the group consisting of stainless steel, cast steel and aluminum.

11. The marine bitt of claim 9 wherein the other end of said marine bitt support structure is aligned with an opening in the hull of said vessel to allow rain and seawater from the deck of said vessel to drain through said marine bitt support structure and the opening in the hull of said vessel into the ocean.

12. The marine bitt of claim 9 wherein said marine bitt when inserted into said marine bitt support structure and secured thereto provides a wedge which resist mooring and towing forces external to said vessel.

13. The marine bitt of claim 9 wherein said marine bitt when inserted into said marine bitt support structure and secured thereto by said locking pin resist internal forces to said vessel by providing a rotational moment which causes the marine bitt to bear against said base and a shear force to be applied to said locking pin.

14. The marine bitt of claim 9 wherein said the rod of said circular post prevents a rope secured to said circular post from sliding upward on said post and being released from said post.

* * * * *